US005750018A

United States Patent [19]

Brasch

[11] Patent Number: 5,750,018

[45] Date of Patent: May 12, 1998

[54] CYANIDE-FREE MONOVALENT COPPER ELECTROPLATING SOLUTIONS

[75] Inventor: William R. Brasch, Nesconset, N.Y.

[73] Assignee: LeaRonal, Inc., Freeport, N.Y.

[21] Appl. No.: 819,061

[22] Filed: Mar. 18, 1997

[51] Int. Cl.[6] ..... C25D 3/38

[52] U.S. Cl. ..... 205/295; 205/297; 205/298; 106/1.26

[58] Field of Search ..... 205/297, 298, 205/295; 106/1.26

[56] References Cited

U.S. PATENT DOCUMENTS

| | | | |
|---|---|---|---|
| 4,126,524 | 11/1978 | Hradil et al. | 204/44 |
| 4,792,469 | 12/1988 | Saito et al. | 427/443.1 |
| 5,302,278 | 4/1994 | Nobel et al. | 205/296 |
| 5,364,460 | 11/1994 | Morimoto et al. | 106/1.23 |
| 5,601,696 | 2/1997 | Asakawa | 106/1.26 |

FOREIGN PATENT DOCUMENTS 0705919 10/1994 European Pat. Off. .

OTHER PUBLICATIONS

Plating and Surface Finishing; May 1988, "Heavy Deposition of Electroless Gold" by M. Matsuoka et al.

*Primary Examiner*—Kathryn L. Gorgos
*Assistant Examiner*—Kishor Mayekar
*Attorney, Agent, or Firm*—Pennie & Edmonds LLP

[57] ABSTRACT

A substantially cyanide-free plating solution for depositing copper from the monovalent ionic state, which includes monovalent copper ion, a reducing agent capable of reducing divalent copper ions to monovalent copper ions, an alkali material in an amount sufficient to maintain the pH of the solution in the range of about 7 to about 10, and a complexing agent of an imide, such as succinimide, 3-methyl-3-ethyl succinimide, 3-methyl succinimide, 3-ethyl succinimide, 3,3,4,4-tetramethyl succinimide, or 3,3,4-trimethyl succinimide, or a hydantoin, such as dimethyl hydantoin. The substantially cyanide-free plating solutions may also include at least one of a conductivity salt, an additive to promote brightness, or an alloying metal. The reducing agent may be an alkali sulfite, alkali bisulfite, hydroxylamine, or hydrazine. The copper is typically provided in the form of CuCl, $CuCl_2$, $CuSO_4$, or $Cu_2O$ in an amount sufficient to provide a monovalent copper concentration of from about 2 to about 30 grams per liter of solution, and the complexing agent is present in an amount sufficient to provide a molar ratio of copper to complexing agent of from about 1:1 to about 1:5, preferably about 1:4. The alkali material is typically NaOH, KOH, $NH_4OH$, or $Na_2CO_3$, and the conductivity salt is typically NaCl, KCl, $Na_2SO_4$, $K_4P_2O_7$, $Na_3PO_4$, $C_6H_5Na_3O_7$, $C_6H_{11}NaO_7$, $NH_4Cl$, or $KNaC_4H_4O_6$. Useful additives include organic amines or oxyalkyl polyamines, such as triethylene tetramine, tetraethylene pentamine, and polyoxypropyltriamine. Methods for preparing such a solution for plating copper onto a substrate, and of plating copper onto a substrate with such a solution are also disclosed.

20 Claims, No Drawings

CYANIDE-FREE MONOVALENT COPPER ELECTROPLATING SOLUTIONS

TECHNICAL FIELD

The present invention is directed to cyanide-free monovalent copper electroplating solutions for depositing copper onto a substrate.

BACKGROUND ART

For many years, copper plating has been successfully performed using cyanide-based plating solutions. In these solutions, copper is present in a complex of monovalent copper and cyanide. The solution may also contain free or uncomplexed alkali cyanide, alkali hydroxide, and complexing agents such as alkali-tartrate to help dissolve copper anodes. Although these solutions have been successful, the industry has constantly been in search of a substitute for poisonous cyanide ions.

Solutions required for the deposition of monovalent copper differ greatly from those required for the deposition of monovalent silver. Monovalent silver is normally stable in solution. However, if any instability exists in the solution, the monovalent silver ions are reduced, and precipitate as silver metal. The reduction of monovalent silver is accelerated by light.

In contrast, it is the divalent ion, rather than the monovalent ion, that is the stable in copper solutions. If an instability exists within a solution containing monovalent copper ions, the ions are oxidized to form stable, divalent copper ions. Where such oxidation occurs, the monovalent copper ions are typically oxidized to divalent copper by oxygen, which enters the solution from the air, or are oxidized electrochemically at the anode.

Acidic, cyanide-free divalent copper plating solutions have been commercially successful. However, these divalent solutions require twice as much total current to deposit the same amount of copper as do monovalent copper solutions. Therefore, for a given current, the plating rate is half that of monovalent copper solutions, and the cost of the electrical current is twice as great. Furthermore, the acidic solutions do not provide the required adhesion of copper when copper is plated directly onto steel.

Alkaline, cyanide-free divalent copper solutions are capable of plating directly onto steel with good adhesion, but have achieved limited commercial acceptance. Because the copper is divalent, the current required to plate copper from acidic divalent copper solutions is about twice that required for plating monovalent copper, and the plating rate for a given amount of current is about half that which is used for plating from monovalent copper solutions.

To date, there are no successful commercial alkaline, monovalent copper plating baths that are stable, cyanide-free, and capable of directly plating steel with good adhesion. Baths containing monovalent copper halides, in particular cuprous chloride or cuprous iodide, with excess alkali halides have been proposed. Neither of these have achieved commercial acceptance.

U.S. Pat. No. 1,969,553 describes a process for plating monovalent copper from a solution containing sodium thiosulfate and cuprous chloride. This process was studied further and reported at the 77th general meeting of the Electrochemical Society, Apr. 26, 1940. A more recent study of the cuprous thiosulfate bath was reported in May 1981 at the annual technical conference of the Institute for Metal Finishing at Herrogate, U.K. These baths plated copper from monovalent solutions in which copper was complexed with a thiosulfate ion, and, reportedly, further improved the stability of the bath by the addition of a sulfite ion. The pH of the solutions was in the range of 6 to 11, with the optimum range being 8.5 to 9.5, with acidic solutions having a pH of 6 or less reportedly being unstable. In addition, sulfur dioxide, resulting from the acidified sulfite ion, continuously evolved from these solutions. The authors concluded that these plating baths offered no significant improvement over an alkaline cupric pyrophosphate bath, and no further work has been reported to date involving thiosulfate-based monovalent copper plating baths.

U.S. Pat. No. 5,302,278 discloses a solution for electroplating at least one monovalent metal, such as copper, silver, or gold under acidic conditions, where the metal is complexed by a thiosulfate ion, and the solution contains a stabilizer of an organic sulfinate.

U.S. Pat. No. 4,126,524 discloses a cyanide-free silver plating bath in which silver is complexed with imides of organic dicarboxylic acids. The examples describe the inclusion of various alloying metals with silver in order to brighten or color the silver deposit. The quantity of alloying metal with silver ranges from a few parts per thousand to about 5% as the upper limit. Among the alloying metal ions listed is monovalent copper plus divalent copper and other metal ions. This process has achieved some commercial success, however, but occasional bath instability has been reported.

EPA 0 705 919 discloses the use of a hydantoin compound in a cyanide-free silver plating solution.

However, a need exists for a stable, cyanide-free, alkaline monovalent copper plating baths that are capable of directly plating steel with good adhesion.

SUMMARY OF THE INVENTION

The present invention is directed to a substantially cyanide-free alkaline plating solution for depositing copper from the monovalent ionic state. Plating solutions of the invention comprise monovalent copper ion, a reducing agent capable of reducing divalent copper ions to monovalent copper ions, an alkali material in an amount sufficient to maintain the pH of the solution in the range of about 7 to about 10, such as NaOH, KOH, $NH_4OH$, or $Na_2CO_3$, and a particular complexing agent. The preferred agents include imide or hydantoin compounds.

Plating solutions according to the invention may also include at least one of a conductivity salt, such as NaCl, KCl, $Na_2SO_4$, $K_4P_2O_7$, $Na_3PO_4$, $C_6H_5Na_3O_7$, $C_6H_{11}NaO_7$, $NH_4Cl$, or $KNaC_4H_4O_6$, an additive to promote brightness, typically an organic amine or an oxyalkyl polyamine, such as triethylene tetramine, tetraethylene pentamine, or polyoxypropyl-triamine, or an alloying metal.

Especially preferred complexing agents for use in the substantially cyanide-free plating solutions of the invention include succinimide, 3-methyl-3-ethyl succinimide, 3-methyl succinimide, 3-ethyl succinimide, 3,3,4,4-tetramethyl succinimide, and 3,3,4-trimethyl succinimide, and a hydantoin compound, preferably dimethyl hydantoin. Useful reducing agents include alkali sulfites, alkali bisulfites, hydroxylamines, and hydrazines, and preferably sodium sulfite.

Copper is provided in form that is soluble in the plating solution, such as CuCl, $CuCl_2$, $CuSO_4$, or $Cu_2O$, in an amount sufficient to provide a copper concentration in the solution of from about 2 to about 30 grams per liter of solution. The complexing agent may be present in an amount sufficient to provide a molar ratio of copper to complexing agent of from about 1:1 to about 1:5, preferably about 1:4. A suitable range is between about 4 and 300 g/l.

The invention is also directed to a method of plating copper onto a substrate, which comprises preparing a cyanide-free plating solution according to the invention, adjusting the temperature of the solution to a temperature of about 60° to 160° F., attaching the substrate to a cathode, immersing the cathode and attached substrate in a bath of the plating solution, and electroplating the substrate with a cathode current to deposit copper thereon.

The invention is also directed to a method of preparing a solution for plating copper onto a substrate, which comprises mixing the source of copper ion, reducing agent, alkali material, and complexing agent, as described above, with water and any of the optional conductivity salts, additives to promote brightness, or an alloying metals in the amounts disclosed above.

DETAILED DESCRIPTION OF THE PREFERRED EMBODIMENTS

The present invention is directed to alkaline, cyanide-free copper solutions and to a method of depositing copper from the monovalent ionic state from such solutions. To avoid the use of cyanide, the solutions of the invention incorporate certain complexing agents of organic imides or hydantoin compounds. It has been unexpectedly discovered that cyanide-free, alkaline plating solutions or baths comprising a copper compound that is soluble in the plating bath, a reducing agent capable of reducing divalent copper ions to monovalent copper ions, and a complexing agent of an imide or hydantoin compound are stable and allow copper to be plated onto steel or copper-based substrates with good adhesion.

The alkaline, cyanide-free solutions for depositing copper from the monovalent ionic state according to the invention typically include copper in the form of a copper compound that is soluble in the plating bath, a reducing agent capable of reducing divalent cupric ions to monovalent cuprous ions, an alkali material, such as an alkali hydroxide, to adjust the pH to a range of about 7 to about 10, and at least one complexing agent of an imide compound of formula I

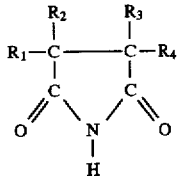

I an imide compound of formula II

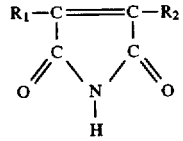

II or a hydantoin compound of formula III

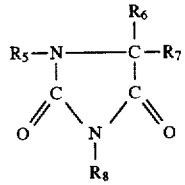

III where $R_1$, $R_2$, $R_3$, and $R_4$ may each be independently the same or different, and are hydrogen, alkyl, or alkoxy, where the alkyl and alkoxy moieties contain one to four carbon atoms, and where $R_5$, $R_6$, $R_7$, and $R_8$ are independently the same or different, and are hydrogen, an alkyl group containing one to five carbon atoms, an aryl group, or an alcohol.

The combination of the complexing agent, which maintains the copper in the monovalent ionic state, and the reducing agent in a plating solution having a pH in the range of from about 7 to about 10 is essential to the invention. Without the reducing agent, substantially all of the monovalent copper is oxidized to divalent copper under typical conditions, and without the complexing agent, the monovalent copper cannot remain soluble in the plating bath.

The amount of complexing agent required in the solution depends upon the amount of copper in the solution. Typically, the molar ratio of copper to complexing agent ranges from about 1:1 to about 1:5, and is preferably about 1:4. A typical range of concentration is between about 4 and 300 g/l, with a more preferred range being 10 to 100 g/l. Useful complexing agents include succinimide, 3-methyl-3-ethyl succinimide, 1–3-methyl succinimide, 3-ethyl succinimide, 3,3,4,4-tetramethyl succinimide, 3,3,4-trimethyl succinimide, maleimide, and hydantoin compounds. The most preferred complexing agent is dimethyl hydantoin because of its low cost and availability.

The amount of copper in the plating bath typically ranges from about 2 to about 30 g/l, depending on the plating speed required for any given application. The copper can be provided in the form of any monovalent or divalent copper compound that is soluble in the plating bath, provides copper that can be complexed by the complexing agent in the bath, and does not degrade the bath. Useful copper compounds include, but are not limited to, CuCl, $CUCl_2$, $CuSO_4$, and $Cu_2O$. Cuprous chloride, CuCl, is preferred because of its availability and low cost.

The reducing agent is any bath soluble compound that is capable of reducing divalent copper to monovalent copper under the conditions present in the plating bath. Useful reducing agents include, but are not limited to, alkali sulfites and bisulfites, hydroxylamines, hydrazines, and the like, as long as the oxidation product does not degrade the plating bath. Sodium sulfite, which produces sodium sulfate as the oxidation product, and is available at low cost, is the most preferred reducing agent. These reducing agents are typically used at a concentration of between about 10 to 150 g/l or more, and preferably between about 15 and 60 g/l.

The pH of the solutions of the invention typically range from about 7 to about 10, preferably from about 8 to about 9. The pH can be adjusted with any base or alkali salt that is compatible with the bath, including NaOH, KOH, $NH_4OH$, $Na_2CO_3$, or the like, and preferably with sodium hydroxide.

Optionally, the solutions of the invention may contain at least one of a conductivity salt, an additive to promote uniformity or brightness of the copper deposits, or an alloying metal. Conductivity salts may be optionally added to improve the conductivity of the bath if necessary. Any salt that is soluble in and compatible with the bath may be used, such as chlorides, sulfates, phosphates, citrates, gluconates, tartrates and the like being suitable. Specifically preferred salts include sodium chloride, NaCl, potassium chloride, KCl, sodium sulfate, $Na_2SO_4$, potassium pyrophosphate, $K_4P_2O_7$, sodium phosphate, $Na_3PO_4$, sodium citrate, $C_6H_5Na_3O_7$, sodium gluconate, $C_6H_{11}NaO_7$, ammonium chloride, $NH_4Cl$, a Rochelle salt, such as potassium sodium tartrate, $KNaC_4H_4O_6$, and the like. These salts are typically used in an amount of 5 to 75 g/l and preferably at about 10 to 50 g/l.

If necessary, additives to improve the brightness and uniformity of the plated copper may be included in the solutions of the invention. Useful additives include organic amine compounds, such as triethylene tetramine and tetraethylene pentamine, and oxyalkyl polyamines, such as polyoxypropyl-triamine, and the like. The amount of amine used depends on its activity in the bath, i.e., its ability to brighten the deposit. For example, triethylene tetramine is preferably used at a concentration of about 0.05 ml per liter of solution, where polyoxypropyltriamine requires about 0.1 g/l. Thus, the amount of this additive can range from 0.01 ml/l to 0.5 g/l and can be determined by routine testing.

A typical plating solution is prepared by first dissolving the complexing agent in water, and then adding the copper compound in crystalline form or as a slurry. The solution is stirred to dissolve the copper compound, the pH is adjusted, and the reducing agent and any of the optional conductivity salts, additives, or alloying metals are added. For plating, the bath is maintained at a temperature that ranges from about 60° to about 160° F. (15° to 71° C.), and is preferably about 110° to about 125° F. (43° to 52° C.). A substrate can then be plated by attaching the substrate to a cathode that is part of an electrical circuit, immersing the cathode and attached substrate in the plating solution, and providing electrical current to the circuit in an amount and for a time sufficient to plate the substrate with copper to a desired thickness. The electroplating conditions are conventional and optimum values can be determined by routine experimentation by one of ordinary skill in the art.

EXAMPLES

The following non-limiting examples are merely illustrative of the preferred embodiments of the present invention, and are not to be construed as limiting the invention, the scope of which is defined by the appended claims.

Example 1

A monovalent copper plating bath was prepared by dissolving the following compounds in deionized water.

| | |
|---|---|
| 5,5 Dimethyl hydantoin | 90 g/l |
| Cuprous chloride | 15 g/l |
| Sodium Bisulfite | 30 g/l |
| Triethylene tetramine | 0.05 ml/l |

The pH of the bath was adjusted to 8.5 with sodium hydroxide. The temperature was maintained at 110° to 125° F. (43° to 52° C.), and the bath was agitated with a motorized stirrer.

Brass and steel panels were electroplated in the bath at cathode current densities of 5 and 10 ampere per square foot (0.54 and 1.08 amps per square decimeter) to a thickness of 0.3 mil (7.5 micron). The time of plating was 48 minutes at 5 A/ft$^2$ and 24 minutes at 10 A/ft$^2$. The deposited copper adhered to the base metal, and was bright in appearance.

Example 2

A monovalent copper plating bath was prepared as in Example 1, except 27 g/l cupric chloride was used as the source of copper ion. Brass and steel panels were plated as in Example 1. The appearance and adhesion of the plated copper were substantially the same as in Example 1.

Example 3

A monovalent copper plating bath was prepared as in Example 1, except 15 g/l cuprous oxide was used as the source of copper ion. Brass and steel panels were plated as in Example 1. The appearance and adhesion of the plated copper were substantially the same as in Example 1.

Example 4

A monovalent copper plating bath was prepared as in Example 1, except 15 g/l cupric hydroxide was used as the source of copper ion. Brass and steel panels were plated as in Example 1. The appearance and adhesion of the plated copper were substantially the same as in Example 1.

Example 5

A monovalent copper plating bath was prepared by dissolving the following compounds in deionized water.

| | |
|---|---|
| 5,5 Dimethyl hydantoin | 75 g/l |
| Cupric Chloride | 27 g/l |
| Sodium Sulfite | 30 g/l |
| Triethylene tetramine | 0.05 ml/l |

The pH of the bath was adjusted to 8 with sodium hydroxide. The temperature was maintained between 110° and 125° F. (43° and 51° C.), and the bath was agitated with a motorized stirrer. Brass and steel panels were plated at cathode current densities of 5 and 10 A/ft$^2$ (0.54 to 1.08 A/dm$^2$). The deposits were semi-bright in appearance, and adhered well to the base metal.

Example 6

A monovalent copper plating bath was prepared by dissolving the following compounds in deionized water.

| | |
|---|---|
| 5,5 Dimethyl hydantoin | 90 g/l |
| Cupric Chloride | 27 g/l |
| Hydroxylamine hydrochloride | 20 g/l |
| Triethylene tetramine | 0.05 ml/l |

The pH of the bath was adjusted to 8.5 with sodium hydroxide. The temperature of the bath was maintained at 110° to 125° F. (43° to 52° C.), and the bath was agitated by a motorized stirrer.

Brass and steel panels were electroplated in the bath at cathode current densities of 5 and 10 A/ft$^2$ (0.54 and 1.08 A/dm$^2$) to a thickness of 0.3 mil (7.5 micron). The time of plating was 48 minutes at 5 A/ft$^2$, and 24 minutes at 10 A/ft$^2$.

The deposit had good adhesion to the base metal, and semi-bright to bright in appearance.

Example 7

A monovalent copper plating bath was prepared by dissolving the following compounds in deionized water.

| | |
|---|---|
| Succinimide | 90 g/l |
| Rochelle Salt | 100 g/l |
| Cupric Chloride | 27 g/l |
| Sodium Sulfite | 30 g/l |
| Triethylene tetramine | 0.05 ml/l |
| Gelatin | 0.5 g/l |

The pH of the bath was adjusted to 8 sodium hydroxide. The temperature was maintained at 110° to 125° F. (43° to 52° C.), and the bath was agitated by a motorized stirrer.

Brass and steel panels were electroplated at cathode current densities of 5 and 10 A/ft$^2$ (0.54 to 1.08 A/dm$^2$) to a thickness of 0.3 mil (7.5 micron).

The deposit adhered well to the base metals, and was mirror bright in appearance.

Example 8

A monovalent copper plating bath was prepared by dissolving the following compounds in deionized water.

| | |
|---|---|
| Succinimide | 90 g/l |
| Cupric Chloride | 30 g/l |
| Sodium Sulfite | 30 g/l |
| Potassium Chloride | 88 g/l |
| Triethylene tetramine | 0.05 ml/l |

The pH of the bath was adjusted to 8 with sodium hydroxide. The temperature of the bath was maintained at 110° to 125° F. (43° to 52° C.), and agitation was supplied by rotating the cathode in the plating bath at 200 rpm (equivalent to 100 ft/min linear speed).

Steel substrates attached to the rotating cathode were subjected to high speed plating in this bath. The electroplating was performed at a cathode current density of 100A/ft$^2$ (10.8 A/dm$^2$).

The plating rate was 0.1 mil, 2.5 micron thickness in 60 seconds. The deposit was smooth to semi-bright in appearance, and adherent to the substrate.

Example 9

A strike copper plating was prepared by dissolving the following compounds in deionized water.

| | |
|---|---|
| 5,5 Dimethyl hydantoin | 60 g/l |
| Potassium Pyrophosphate | 30 g/l |
| Cupric Hydroxide | 2 g/l |

The pH of the bath was adjusted to 8.5 with potassium hydroxide. The temperature was maintained at 90° to 110° F. (32° to 43° C.). Zinc die cast parts were first cleaned and activated in the conventional manner, then electroplated in the above strike bath at 10 A/ft$^2$ (1.08 A/dm$^2$) for 10 minutes. A uniform pink copper coating was deposited over the entire substrate. The parts were then electroplated in the bath described in Example 1 at 10 A/ft$^2$ (1.08 A/dm$^2$) for 24 minutes. The deposit was uniformly bright in appearance, and the adhesion to the zinc die cast base metal was excellent.

As demonstrated by the examples, the alkaline, cyanide-free monovalent copper plating solutions of the invention, when plated onto a substrate, such as steel zinc, or brass, provide a copper plate that is bright in appearance, and adheres well to the substrate.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

What is claimed is:

1. A substantially cyanide-free plating solution for depositing copper from a monovalent ionic state, which comprises a source of copper ions a reducing agent capable of reducing divalent copper ions to monovalent copper ions, an alkali material in an amount sufficient to maintain the solution in a pH range of about 7 to about 10, and a complexing agent of an imide or hydantoin compound, wherein the combined amount of complexing agent and reducing agent are sufficient to reduce divalent copper ions to monovalent copper ions.

2. The substantially cyanide-free plating solution of claim 1, wherein the complexing agent is an imide compound of formula I

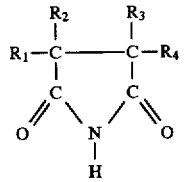

I an imide compound of formula II

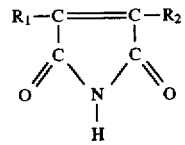

II or a hydantoin compound of formula III

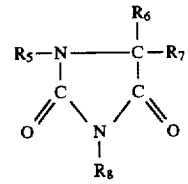

III wherein where $R_1$, $R_2$, $R_3$, and $R_4$ may each be independently the same or different, and are hydrogen, alkyl, or alkoxy, where the alkyl and alkoxy moieties contain one to four carbon atoms, and wherein $R_5$, $R_6$, $R_7$, and $R_8$ are independently the same or different, and are hydrogen, an alkyl group containing one to five carbon atoms, an aryl group, or an alcohol.

3. The substantially cyanide-free plating solution of claim 1, wherein the complexing agent is present in the solution in an amount of between about 4 and 300 g/l of solution and the reducing agent is present in an amount of between about 10 and 150 g/l of solution.

4. The substantially cyanide-free plating solution of claim 1, wherein the complexing agent is succinimide, 3-methyl-3-ethyl succinimide, 1-3-methyl succinimide, 3-ethyl succinimide, 3,3,4,4-tetramethyl succinimide, 3,3,4-trimethyl succinimide, maleimide, or a hydantoin compound.

5. The substantially cyanide-free plating solution of claim 1, wherein the reducing agent is an alkali sulfite, alkali bisulfite, hydroxylamine, or hydrazine.

6. The substantially cyanide-free plating solution of claim 1, wherein the complexing agent is dimethyl hydantoin and the reducing agent is sodium sulfite.

7. The substantially cyanide-free plating solution of claim 1, wherein the source of copper ions is CuCl, $CUCl_2$, $CuSO_4$, or $Cu_2O$.

8. The substantially cyanide-free plating solution of claim 1, wherein the copper ions are present in the solution in a concentration of from about 2 to about 30 g/l of solution.

9. The substantially cyanide-free plating solution of claim 8, wherein the source of copper ions and complexing agent are present in amounts sufficient to provide a molar ratio of copper ions to complexing agent of from about 1:1 to about 1:5.

10. The substantially cyanide-free plating solution of claim 9, wherein the molar ratio of the copper ions to completing agent is between about 1:2 and about 1:4.

11. The substantially cyanide-free plating solution of claim 1, further comprising at least one of a conductivity salt, an additive to promote brightness, or an alloying metal.

12. The substantially cyanide-free plating solution of claim 11, wherein the alkali material is NaOH, KOH, $NH_4OH$, or $Na_2CO_3$.

13. The substantially cyanide-free plating solution of claim 11, wherein the conductivity salt is NaCl, KCl, $Na_2SO_4$, $K_4P_2O_7$, $Na_3PO_4$, $C_6H_5Na_3O_7$, $C_6H_{11}NaO_7$, $NH_4Cl$, or $KNaC_4H_4O_6$.

14. The substantially cyanide-free plating solution of claim 11, wherein the additive is an organic amine or an oxyalkyl polyamine.

15. The substantially cyanide-free plating solution of claim 11, wherein the additive is triethylene tetramine, tetraethylene pentamine, or polyoxypropyl-triamine.

16. A method of plating copper onto a substrate, which comprises preparing a cyanide-free monovalent copper plating solution by mixing a source of copper ions, a reducing agent capable of reducing divalent copper ions to monovalent copper ions, an alkali material in an amount sufficient to maintain the solution in a pH range of about 7 to about 10, and a complexing agent of an imide or hydantoin compound, wherein the combined amount of completing agent and reducing agent are sufficient to reduce divalent copper ions to monovalent copper ions; adjusting the solution to a temperature range of about 60° to 160° F.; immersing the substrate in the solution; and electroplating copper onto the substrate.

17. The method of claim 16, wherein the complexing agent and the source of copper ions are added to the solution in an amount sufficient to provide a molar ratio of copper to complexing agent of from about 1:1 to about 1:5 liter of solution.

18. The method of claim 16, wherein the complexing agent is selected to be an imide compound of formula I

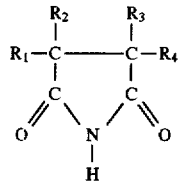

I an imide compound of formula II

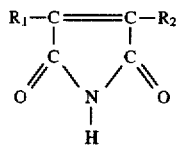

II or a hydantoin compound of formula III

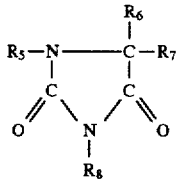

III wherein where $R_1$, $R_2$, $R_3$, and $R_4$ may each be independently the same or different, and are hydrogen, alkyl, or alkoxy, where the alkyl and alkoxy moieties contain one to four carbon atoms, and wherein $R_5$, $R_6$, $R_7$, and $R_8$ are independently the same or different, and are hydrogen, an alkyl group containing one to five carbon atoms, an aryl group, or an alcohol.

19. The method of claim 16, further comprising adding at least one of a conductivity salt, an additive to promote brightness, or an alloying metal to the plating solution.

20. The method of claim 16, wherein the temperature of the plating solution is adjusted to a temperature in the range of from about 100° to about 125° F.

* * * * *